United States Patent [19]

Crosier et al.

[11] 4,285,563

[45] Aug. 25, 1981

[54] CABLE CONNECTOR AND CAP SHOES THEREFOR

[75] Inventors: Claire G. Crosier, San Marcos; Charles W. Waas, Huntington Beach, both of Calif.

[73] Assignee: Communications Technology Corporation, Los Angeles, Calif.

[21] Appl. No.: 60,997

[22] Filed: Jul. 26, 1979

[51] Int. Cl.[3] ..... H01R 13/635

[52] U.S. Cl. ..... 339/45 M; 339/75 M; 339/91 R; 339/255 R

[58] Field of Search ..... 339/91 R, 75 R, 75 M, 339/150 A, 150 C, 98, 99 R, 151 R, 151 B, 255 R, 64 R, 64 M, 42, 44 R, 44 M, 45 R, 45 M; 179/1 PC, 175, 25

[56] References Cited

U.S. PATENT DOCUMENTS

| | | | |
|---|---|---|---|
| 1,394,057 | 10/1921 | Woernley | 339/42 X |
| 3,534,320 | 10/1970 | Rushing | 339/75 M X |
| 3,736,387 | 5/1973 | Thompson et al. | 339/151 B X |
| 3,772,635 | 11/1973 | Frey et al. | 339/98 X |
| 3,781,758 | 12/1973 | Anderson | 339/150 B X |
| 4,128,739 | 12/1978 | Bernstein | 339/255 R X |

*Primary Examiner*—Eugene F. Desmond

[57] ABSTRACT

A cap shoe system for making electrical connections between a plurality of conductors in one cable and a corresponding plurality of conductors in a connector module of a connector which includes an index strip, the connector module, and a connector-module cap, and/or for making electrical connections between a plurality of conductors in another cable and a corresponding plurality of conductors in a bridge module forming part of the connector and including a bridge-module cap. The connector-module and bridge-module caps have access holes for connector-module and bridge-module contact pins respectively carried by connector-module and bridge-module cap shoe bodies having connector-module and bridge-module slide members which are retractable to provide for entry of the connector-module and bridge-module contact pins through the access holes in the connector-module and bridge-module caps into electrical contact with the respective conductors in the connector and bridge modules. The index strip also has access holes adapted to receive the connector-module contact pins to make electrical connections with conductors in the index strip.

7 Claims, 20 Drawing Figures

CABLE CONNECTOR AND CAP SHOES THEREFOR

BACKGROUND OF INVENTION

The present invention relates in general to devices, commonly referred to as tap shoes, for making electrical connections between pluralities of conductors in cables and corresponding pluralities of conductors in various conductor-system components, and particularly telephone conductor-system components, such as terminals, connectors, and the like.

More particularly, the present invention relates to shoes for making electrical connections between pluralities of conductors in cables and corresponding pluralities of conductors in conductor and/or bridge modules of a connector, commonly known in the telephone industry as a 710 connector, having substantially the structure disclosed in Frey et al U.S. Pat. No. 3,772,635, granted Nov. 13, 1973. Basically, such a connector includes an index strip, a connector module and a connector-module cap, and may also include a bridge module having a bridge-module cap, each such module being adapted to accommodate, for example, 50 telephone conductors, or the like. As will become apparent, the shoes of the present invention make electrical connections between the respective cable conductors and the corresponding connector-module and bridge-module conductors through the connector-module and bridge-module caps, and, therefore, are referred to herein as cap shoes.

Representative of prior U.S. patents relating to shoes for making electrical connections between a plurality of cable conductors and a corresponding plurality of conductors in a conductor-system component is U.S. Pat. No. 4,128,739, granted Dec. 5, 1978 to Albert Bernstein.

OBJECTS AND SUMMARIES OF INVENTION

A general object of the invention is to provide connector-module and/or bridge-module cap shoes for respectively making electrical connections with conductors in connector and/or bridge modules through access holes in the respective connector-module and bridge-module caps, or with conductors in the index strip through access holes in that component.

An important object of the invention is to provide, and the invention may be summarized as comprising, a connector-module cap shoe for making electrical connections between a plurality of conductors in a cable and a corresponding plurality of conductors in a connector module or index strip of a connector which includes the index strip, the connector module and a cap, the connector-module cap shoe including: a connector-module cap shoe body of a size and shape to accommodate the index strip, the connector module and the cap forming the connector; releasable means for securing the connector-module cap shoe body to the connector; a plurality of spring loaded contact pins carried by the connector-module cap shoe body and insertable through the respective access holes in the connector-module cap into electrical contact with the respective conductors in the connector module, or through corresponding access holes in the index strip into electrical contact with conductors in the index strip; a slide member mounted on the connector-module cap shoe body and slidable relative thereto between extended and retracted positions in a direction parallel to the axes of the corresponding contact pins, and including spacer means through which the contact pins extend; and whereby the contact pins in the connector-module cap shoe body enter the access holes in the connector-module, or the access holes in the index strip, into electrical contact with the respective conductors therein upon retraction of the slide member.

An object related to the foregoing is to provide the connector-module cap shoe body with arms of a spacing to receive the connector therebetween, the releasable means mentioned including coaxial retaining pins respectively carried by such arms and extensible inwardly toward each other under the index strip or cap of the connector, the slide member automatically retracting upon insertion of the connector between the arms on the connector-module cap shoe body and upon inward extension of the retaining pins, whereby the corresponding contact pins enter the access holes in the connector-module or index strip into electrical contact with the respective conductors in such components.

Another important object of the invention is to provide, and the invention may be further summarized as comprising, a bridge-module cap shoe for making electrical connections between a plurality of conductors in a cable and a corresponding plurality of conductors in a bridge module of a connector having substantially the structure disclosed in the aforementioned Frey et al patent, the bridge module being provided with a bridge-module cap having access holes leading to the respective conductors in the bridge module, the bridge-module cap shoe including: a bridge-module cap shoe body of a size and shape to accommodate the bridge module and the bridge-module cap; a plurality of spring loaded contact pins carried by the bridge-module cap shoe body and insertable through the respective access holes in the bridge-module cap into electrical contact with the respective conductors in the bridge module; a bridge-module slide member mounted on the bridge-module cap shoe body and slidable relative thereto between extended and retracted positions in a direction parallel to the axes of the corresponding contact pins, and carrying spacer means through which such contact pins extend; and whereby the contact pins carried by the bridge-module cap shoe body enter the access holes in the bridge-module cap into electrical contact with the respective conductors in the bridge module upon retraction of the bridge-module slide member.

Still another object is to provide a bridge-module cap shoe including interengageable means on the bridge-module cap shoe body and the bridge-module slide member for releasably securing such slide member in its retracted position.

A further object is to provide a connector-module and/or bridge-module cap shoe wherein the corresponding slide member is generally U-shaped and embraces the corresponding cap shoe body.

Yet another object of the invention is to provide cap shoes having the foregoing characteristics wherein the slide members are spring loaded toward their extended positions, wherein the spacer means thereof at least nearly enclose the free ends of the corresponding contact pins. Another result of such a construction is that the spacer means of each cap shoe insures accurate alignment of the corresponding contact pins with the access holes in the corresponding component, which is an important feature. Further, the contact pins are individually spring loaded toward their extended positions so that each contact pin is able to seek its own level of contact within the corresponding connector or bridge module, thereby insuring the correct electrical connection.

The foregoing objects, advantages, features and results of the present invention, together with various other objects, advantages, features and results thereof which will be evident to those skilled in the art in the light of this disclosure, may be achieved with the exemplary embodiments of the invention illustrated in the accompanying drawings and described in detail hereinafter.

DETAILED DESCRIPTION OF EXEMPLARY EMBODIMENT OF INVENTION

Connector-Module Cap Shoe, FIGS. 1–11 and 17–20

Figure 1:
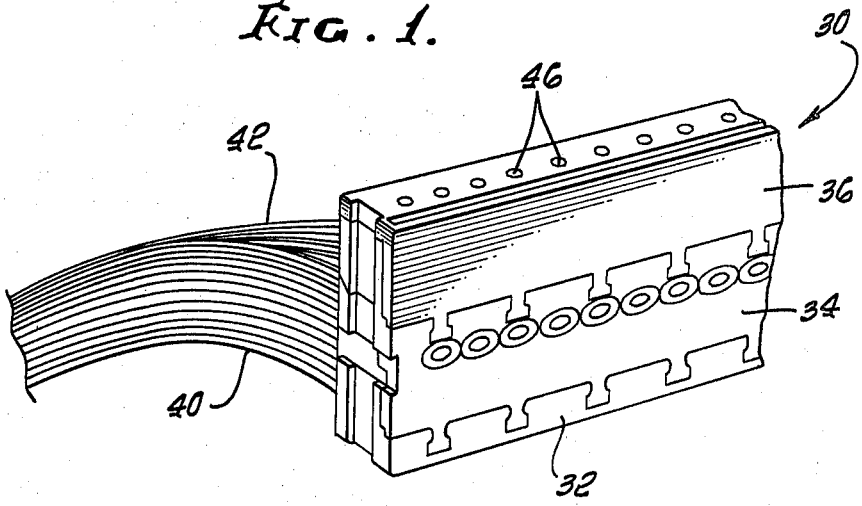
FIG. 1 is a fragmentary perspective view of a so-called 710 connector substantially as disclosed in the aforementioned Frey et al patent, and including an index strip, a connector module and a connector-module cap.
Figure 2:
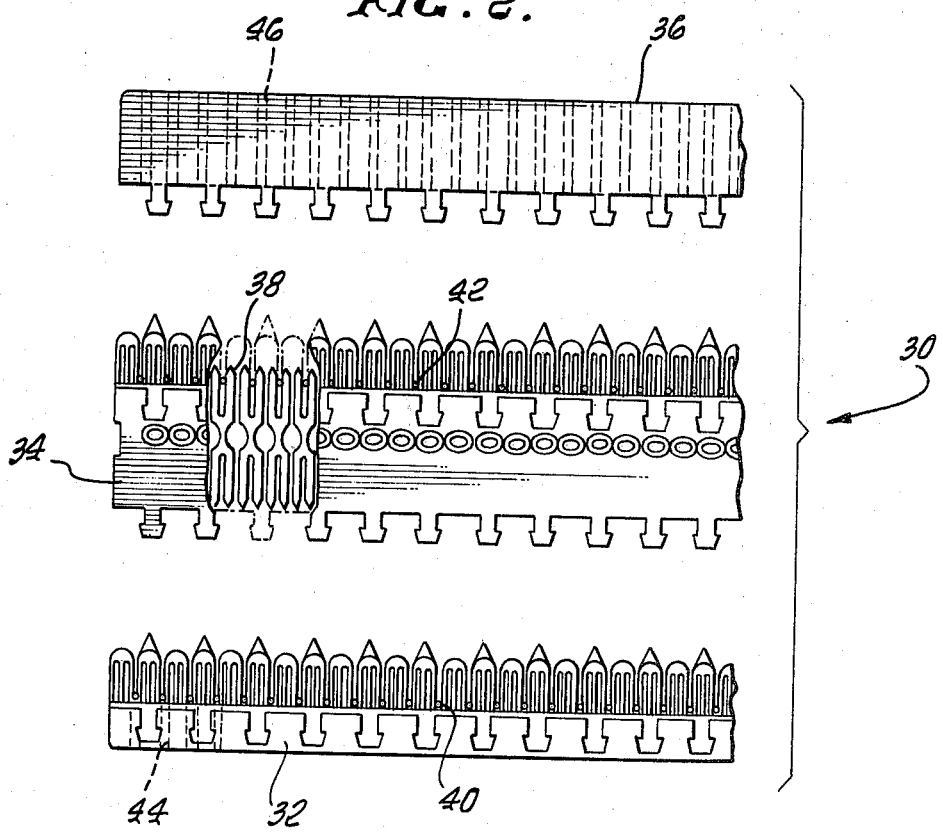
FIG. 2 is an exploded elevational view, partially in section, showing the components of the connector illustrated in FIG. 1.

Referring initially to FIGS. 1 and 2 of the drawings in particular, illustrated fragmentarily therein is a connector 30 having substantially the structure fully disclosed in the aforementioned Frey et al patent, thereby making it unnecessary to describe the connector 30 in detail herein. Briefly, the connector 30 includes an index strip 32, a connector module 34 and a connector-module cap 36. The connector module 34 carries plural contacts 38 capable of receiving conductors 40 extending into the index strip 32 and conductors 42 extending into the connector module 34. The index strip 32 is provided with access holes 44 for access to the conductors 40, and the connector-module cap 36 is provided with access holes 46 for access to the conductors 42, such access holes being an important aspect of the invention.

Figure 15:
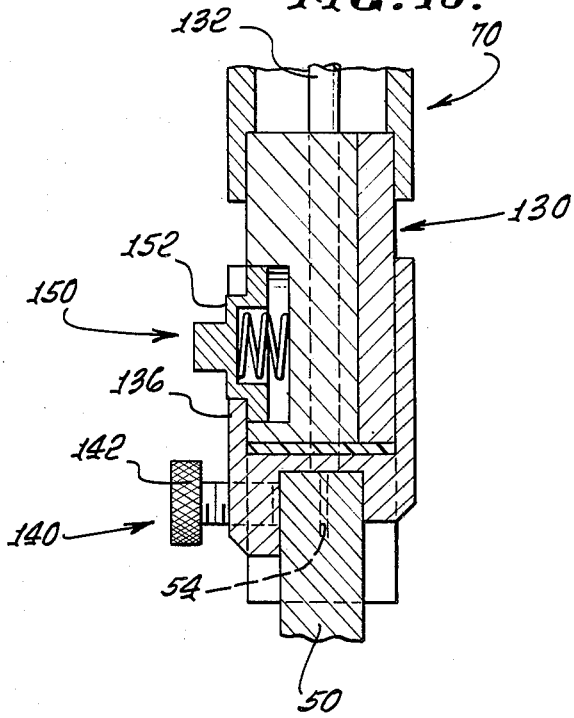
FIG. 15 is an enlarged, fragmentary sectional view taken as indicated by the arrowed line 15—15 of FIG. 13.
Figure 16:
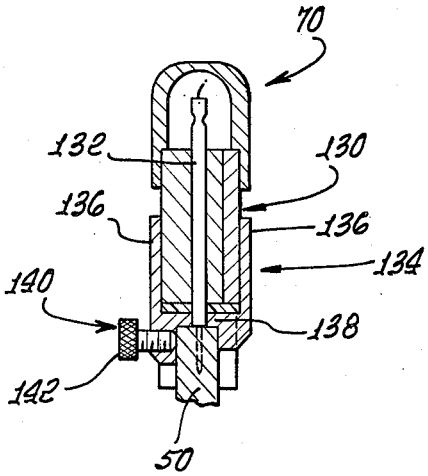
FIG. 16 is a sectional view taken as indicated by the arrowed line 16—16 of FIG. 13.
Figure 13:
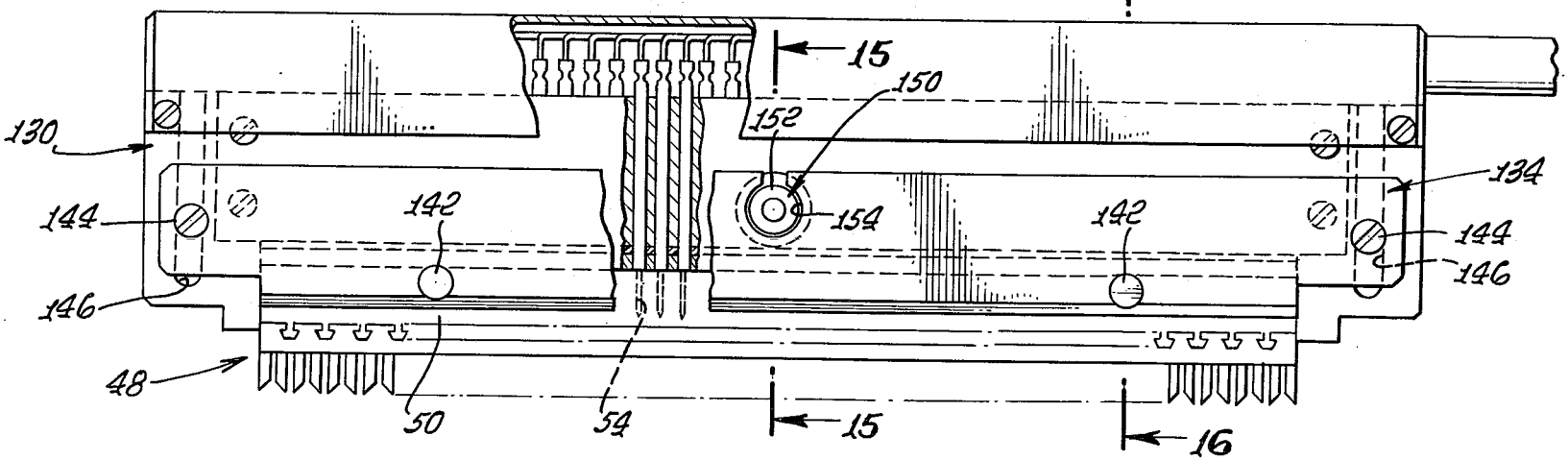
FIG. 13 is an elevational view similar to FIG. 12, but showing the bridge-module cap shoe of the invention and a bridge module of the connector in operative relationship.
Figure 17:
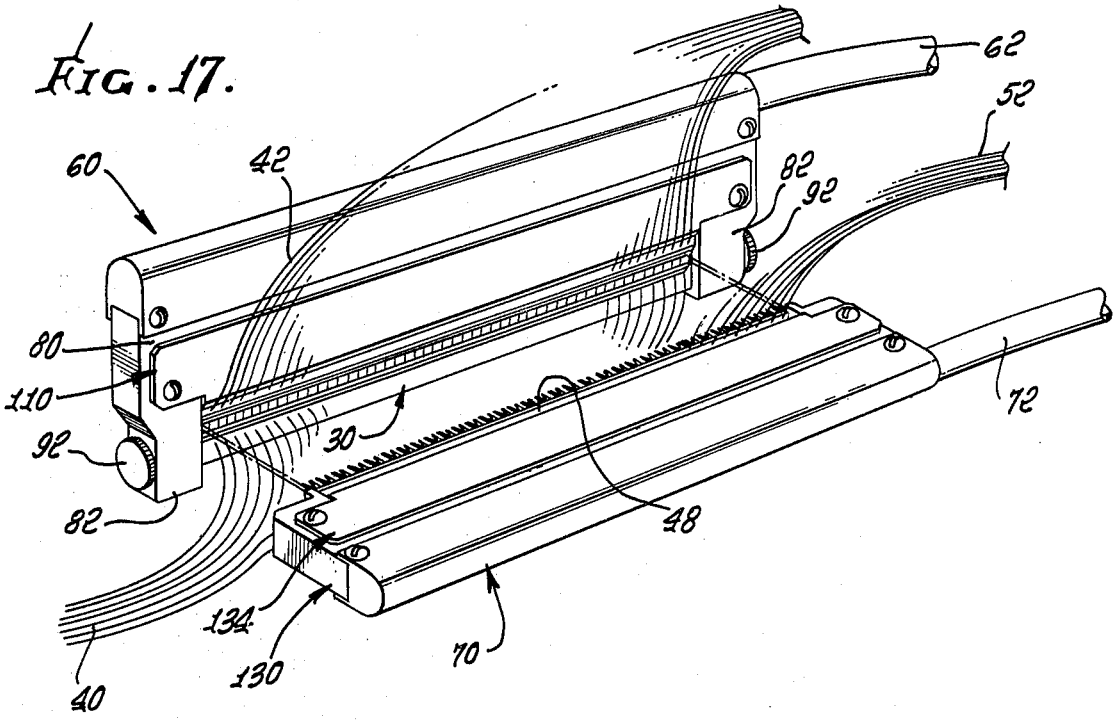
FIG. 17 is an exploded perspective view showing the connector-module cap shoe of the invention in its operative relationship with the index strip, connector module and connector-module cap of the connector, and showing the bridge-module cap shoe in its operative relationship with the bridge module and bridge-module cap of the connector.

Completing the aforementioned brief description of the connector 30, it may also include, as best shown in FIGS. 13 and 17, a bridge module 48 having a bridge-module cap 50 and adapted to accommodate a plurality of conductors 52, FIG. 17. As fully disclosed in the aforementioned Frey et al patent, the bridge-module conductors 52 engage contacts in the bridge module 48 similar to the contacts 38 hereinbefore mentioned, and, as also shown in the Frey et al patent, the bridge module 48 and bridge-module cap 50 may be assembled with the index strip 32, the connector module 34 and the connector-module cap 36 of the connector 30 to establish electrical interconnection between the bridge-module conductors 52 and the conductors 40 and/or 42. Consequently, a detailed description herein is not necessary. Another important aspect of the invention is that the bridge-module cap 50 is provided with access holes 54, FIG. 15, for access to the bridge-module conductors 52.

Considering the present invention generally now, it includes a connector-module cap shoe 60, FIGS. 3–11 and 17–20, for making electrical connections between conductors in a cable 62 and the respective conductors 40 through the access holes 44, or the respective conductors 42 through the access holes 46, depending on the position of the connector 30 relative to the connector-module cap shoe 60. For convenience hereinafter, the connector-module cap shoe 60 will be considered only in conjunction with access to the conductors 42 through the access holes 46 in the connector-module cap 36.

Completing a general description of the invention, it also includes a bridge-module cap shoe 70, FIGS. 12, 13 and 17–20, for making electrical connections between conductors in a cable 72 and the bridge-module conductors 52 through the access holes 54. The bridge-module cap shoe 70 will be described in detail in a subsequent section of this specification.

Figure 4:
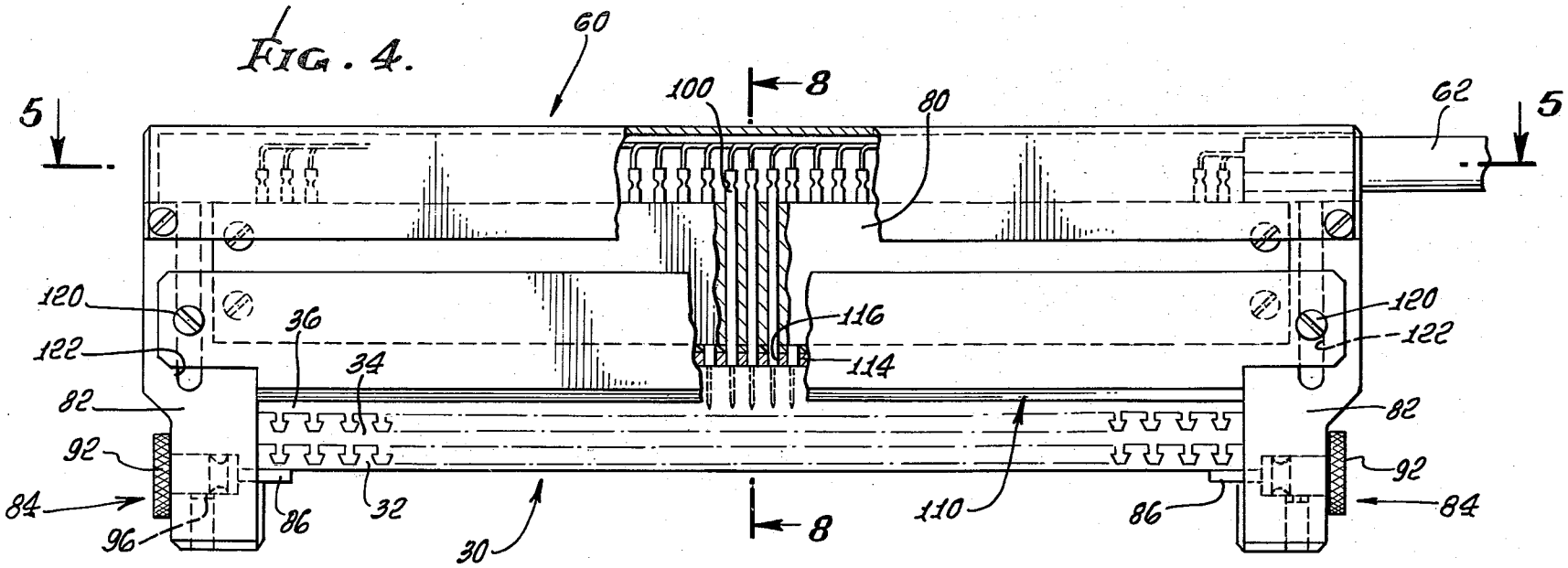
FIG. 4 is an elevational view similar to FIG. 3, but showing the connector-module cap shoe and the corresponding connector in their operative relationship.
Figure 5:
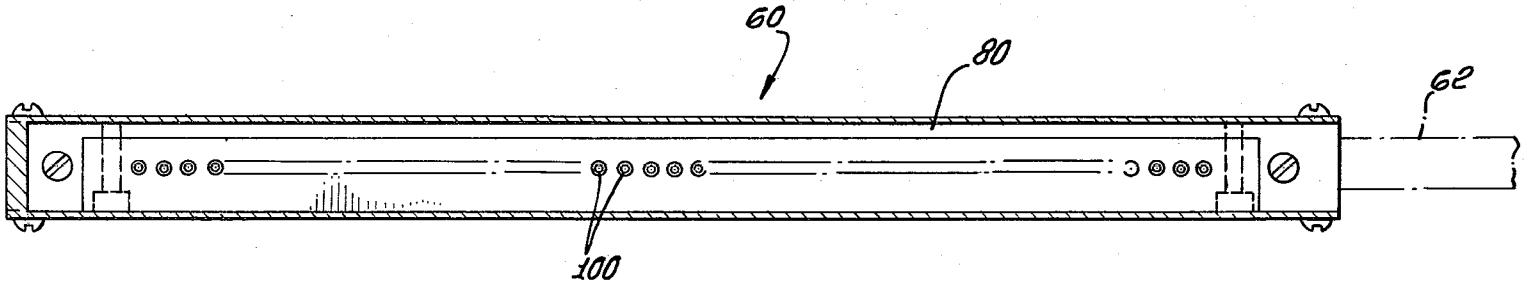
FIG. 5 is a sectional view taken as indicated by the arrowed line 5—5 of FIG. 4.

Turning now, in this section of the specification, to a detailed description of the connector-module cap shoe 60, it includes a connector-module cap shoe body 80 of a size and shape to accommodate the connector 30, i.e., the index strip 32, the connector module 34 and the connector-module cap 36, with either the index strip 32, or the cap 36, exposed, depending on whether electrical connections are to be made through the access holes 44 in the index strip 32, or the access holes 46 in the cap 36. In FIG. 4, the index strip 32 is exposed to provide for making electrical connections through the access holes 46 in the cap 36.

Figure 3:
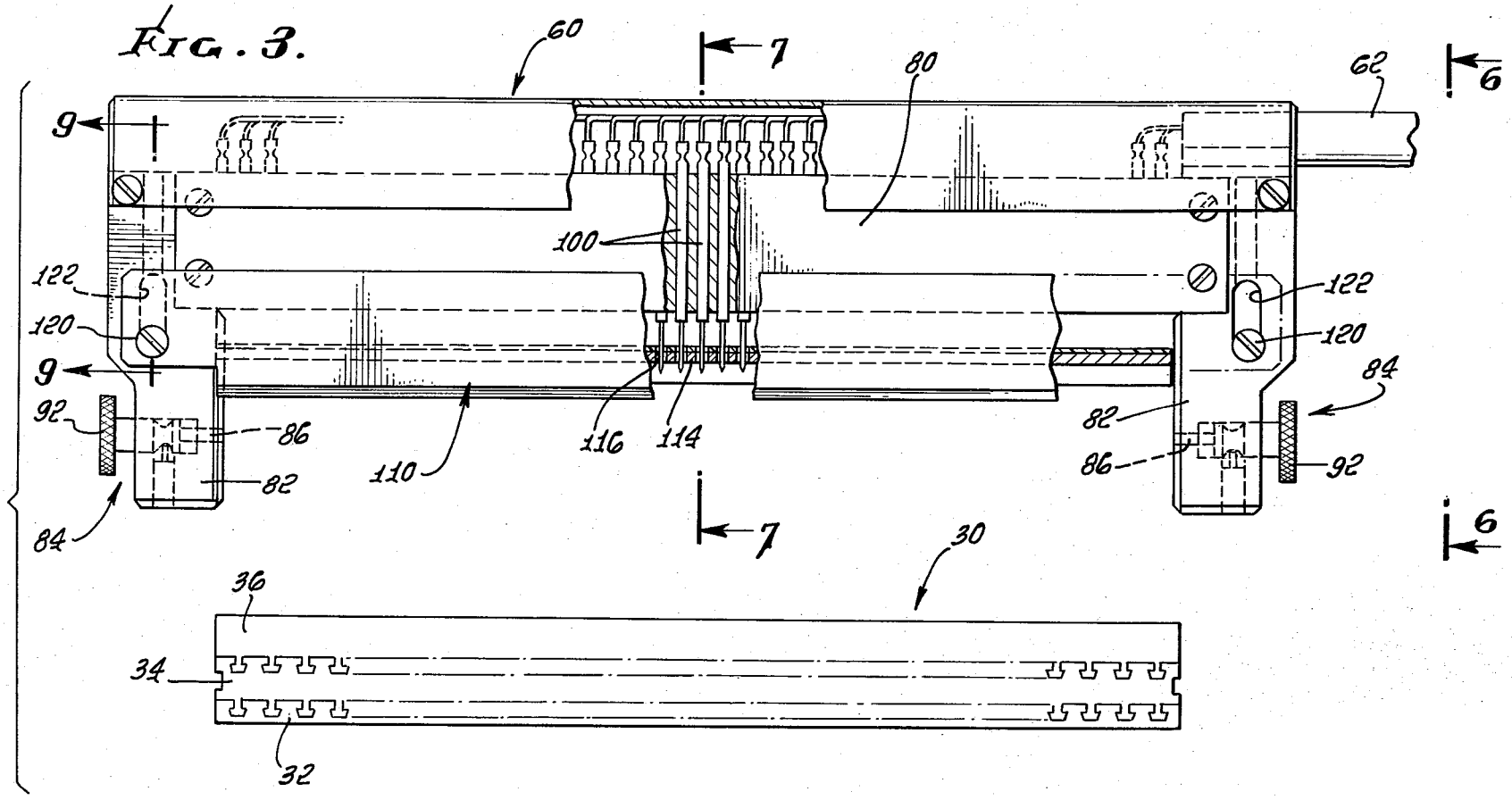
FIG. 3 is an exploded elevational view showing a connector-module cap shoe of the invention and the connector with which it is to be used, the connector-module cap shoe being shown partially in section.

As best shown in FIGS. 3 and 4, the cap shoe body 80 is generally U-shaped and includes arms 82 of a spacing to receive the connector 30 therebetween, i.e., of a spacing to receive the index strip 32, the connector module 34 and the connector-module cap 36 therebetween, with either the index strip 32 or the cap 36 exposed.

The cap shoe body 80 carries releasable means 84 for securing the connector 30 thereto, with the ends of the connector engaging the respective arms 82. More particularly, the releasable means 84 includes coaxial retaining pins 86 respectively carried by the arms 82 and extensible inwardly toward each other under the index strip 32 of the connector 30, or under the cap 36 of the connector 30, depending on whether electrical connections are to be made through the access holes 46 in the cap 36, or the access holes 44 in the index strip 32. In FIG. 4 of the drawings, the retaining pins 86 are shown extended under the index strip 32 for convenience.

Figure 10:
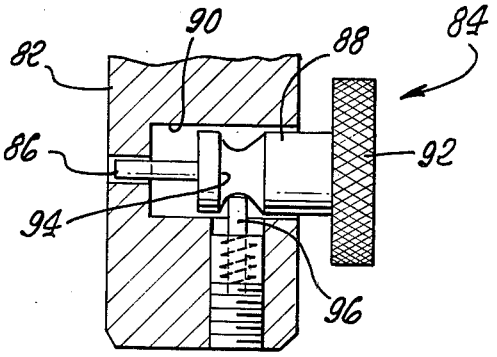
FIG. 10 is a fragmentary sectional view duplicating a portion of FIG. 3 or FIG. 4, and showing one of the retaining pins of the connector-module cap shoe in section.

As best shown in FIG. 10, each retaining pin 86 is carried by a slidable retaining member 88 in a bore 90 in the corresponding arm 82, such retaining member also carrying an exposed actuating knob 92. Each retaining member 88 is provided with an annular groove 94 of rounded cross section to receive a spring-loaded latch pin 96 adapted to releasably latch the corresponding retaining pin 86 in its retracted position. As will be apparent, by pushing inwardly on the knob 92, the corresponding retaining pin 86 may be extended.

As will be apparent, the connector-module cap shoe body 80 carries a row of spring-loaded contact pins 100 respectively insertable into the access holes 44 in the index strip 32, or the access holes 46 in the connector-module cap 36. The contact pins 100 are respectively electrically connected to the conductors in the connector-module cap shoe cable 62. It will be understood that when the contact pins 100 enter the access holes 44 in the index strip 32, they make electrical connections with the conductors 40 in the index strip, and when they enter the access holes 46 in the cap 36, they make electrical connections with the conductors 42 in the connector module 34. The manner in which this is accomplished is conventional in tap shoes and a further explanation is not necessary.

Figure 11:
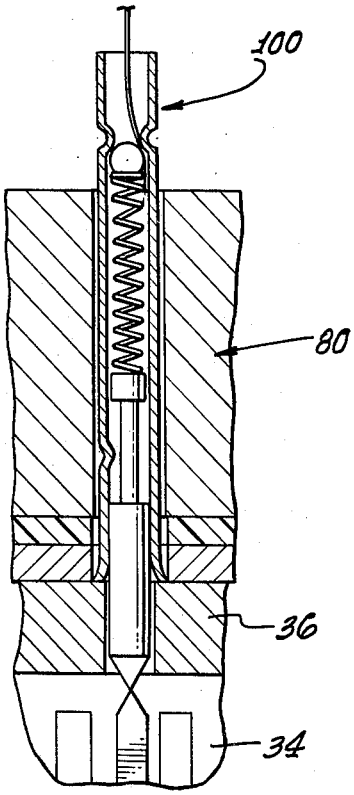
FIG. 11 is an enlarged sectional view showing one of the contact pins utilized in either cap shoe of the invention in more detail, such contact pin being disclosed and claimed in co-pending application Ser. No. 087,205, filed Oct. 22, 1979 by Claire G. Crosier, one of the inventors named herein, and Frank W. Korber, and assigned to the same assignee as the present application.
Figure 14:
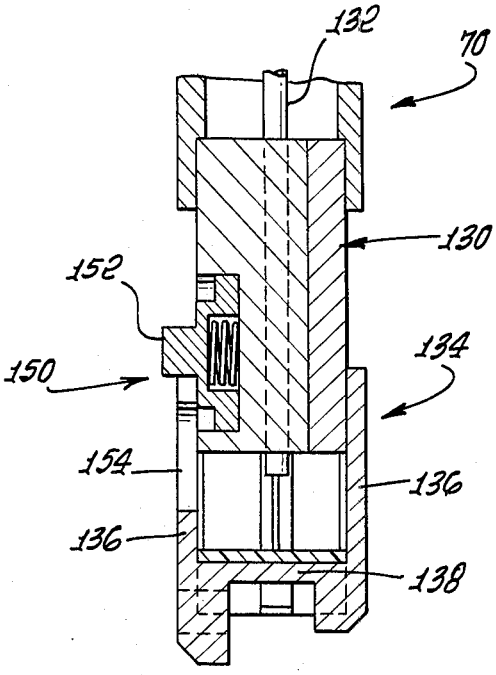
FIG. 14 is a fragmentary sectional view taken as indicated by the arrowed line 14—14 of FIG. 12.

FIG. 11 shows one of the contact pins 100 in more detail. Since such contact pin is fully disclosed in the aforementioned Crosier-Korber patent application, a detailed description herein is unnecessary.

The connector-module cap shoe 60 also includes a generally U-shaped slide member 110 which extends lengthwise of and laterally embraces the connector-module cap shoe body 80. Epxressed differently, the U-shaped slide member 110 has laterally spaced flanges 112, as best shown in FIGS. 6–9, which receive the cap shoe body 80 therebetween and act as covers for opposite sides of the cap shoe body. The two flanges 112 of the slide member 110 are joined by a spacer means 114 having a row of openings 116 therethrough matching the row of contact pins 100, thereby providing accurate alignment of the contact pins with the access holes 44 in the index strip 32, or the access holes 46 in the cap 36, which is an important feature.

Figure 7:
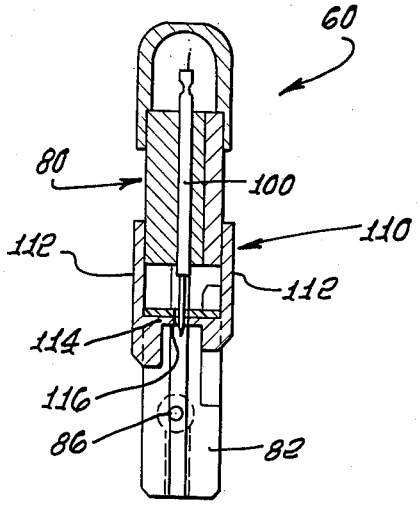
FIG. 7 is a sectional view taken as indicated by the arrowed line 7—7 of FIG. 3.
Figure 6:
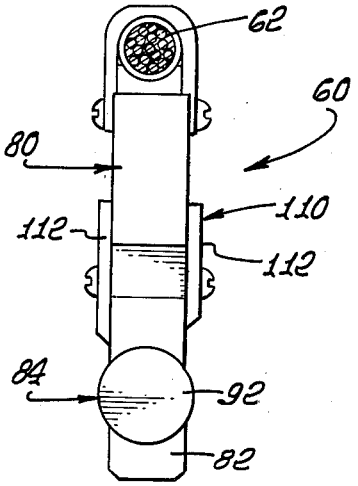
FIG. 6 is an end view, partially in section, taken as indicated by the arrowed line 6—6 of FIG. 3.
Figure 9:
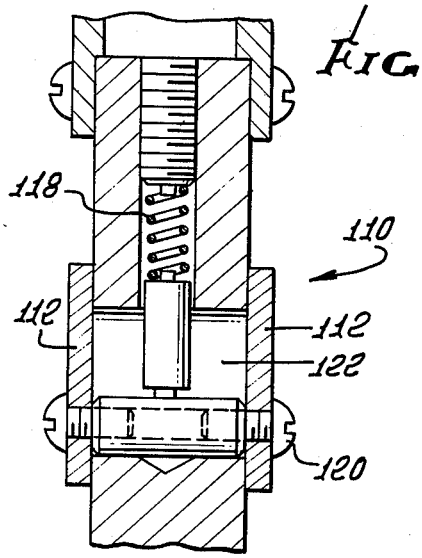
FIG. 9 is a fragmentary sectional view taken as indicated by the arrowed line 9—9 of FIG. 3.
Figure 8:
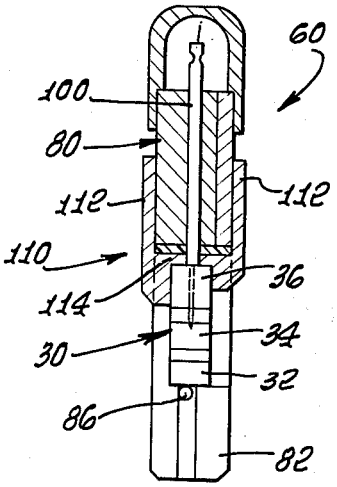
FIG. 8 is a sectional view taken as indicated by the arrowed line 8—8 of FIG. 4.

The slide member 110 is spring biased at its ends toward an extended position, shown in FIGS. 3 and 7, wherein the spacer means 114 nearly covers the free ends of the contact pins 100. More particularly, as best shown in FIG. 9, at each end of the slide member 110 there is a compression spring 118 which acts to bias the corresponding end of the slide member 110 toward its extended position. Movement of the slide member 110 beyond its extended and retracted positions is prevented by engagement of stop screws 120, FIGS. 3 and 4, with the respective ends of slots 122 in the cap shoe body 80. More particularly, as shown in FIG. 3, the stop screws 120 engage the outer ends of the slots 122 to limit movement of the slide member 110 beyond its extended position. As shown in FIG. 4, the stop screws 120 engage the inner ends of the slots 122 to limit movement of the slide member 110 beyond its retracted position.

It is thought that the operation of the connector-module cap shoe 60 will be apparent from the drawings and the foregoing description so that only a brief explanation will be necessary. Assuming that electrical connections between the contact pins 100 and the conductors 42 are to made through the access holes 46, the index strip 32, the connector module 34 and the connector-module cap 36 are inserted between the arms 82 of the cap shoe body 80 with the cap 36 innermost and the index strip 32 exposed, and the retaining pins 86 are inserted "under" the index strip 32, all as shown in FIG. 4. As this is done, the various contact pins 100 enter the respective access holes 46 in the cap 36, the slide member 110 being displaced inwardly toward its retracted position to fully expose the contact pins as they enter the respective access holes 46. As previously pointed out, each contact pin 100 is able to seek its own level of contact with the corresponding conductor 42, or more accurately, the corresponding contact 38 within the connector module 34.

A similar mode of operation applies when electrical connections are to be made through the access holes 44 in the index strip 32, except that the position of the connector 30 relative to the connector-module cap shoe 60 is reversed.

DETAILED DESCRIPTION OF EXEMPLARY EMBODIMENT OF INVENTION

Bridge-Module Cap Shoe, FIGS. 12–20

Turning now to FIGS. 12–17 of the drawings, the bridge-module cap shoe 70 of the invention is similar in many respects to the connector-module cap shoe 60. More particularly, the cap shoe body 130 is of a size and shape to accommodate the bridge module 48 and its cap 50 and carries spring loaded contact pins 132 respectively insertable into the access holes 54 in the bridge-module cap 50. The contact pins 132 are preferably identical to the contact pins 100.

The bridge-module cap shoe 70 also includes a U-shaped slide member 134 similar to the slide member 110 and similarly slidably mounted on the bridge-module cap shoe body 130. More specifically, the slide member 134 includes laterally spaced flanges 136 which laterally embrace the cap shoe body 130 and which are interconnected by a spacer means 138, FIGS. 14 and 15, having essentially the same relationship with the contact pins 132 as the spacer means 114 of the connector-module cap shoe 60 has with the contact pins 100.

The slide member 134 carries releasable means 140 for securing the bridge module 48 and the bridge-module cap 50 to the bridge-module cap shoe body 130. More particularly, the releasable means 140 simply comprises two screws 142, FIG. 13, mounted on the slide member 134 and engageable with the bridge module 48.

Figure 12:
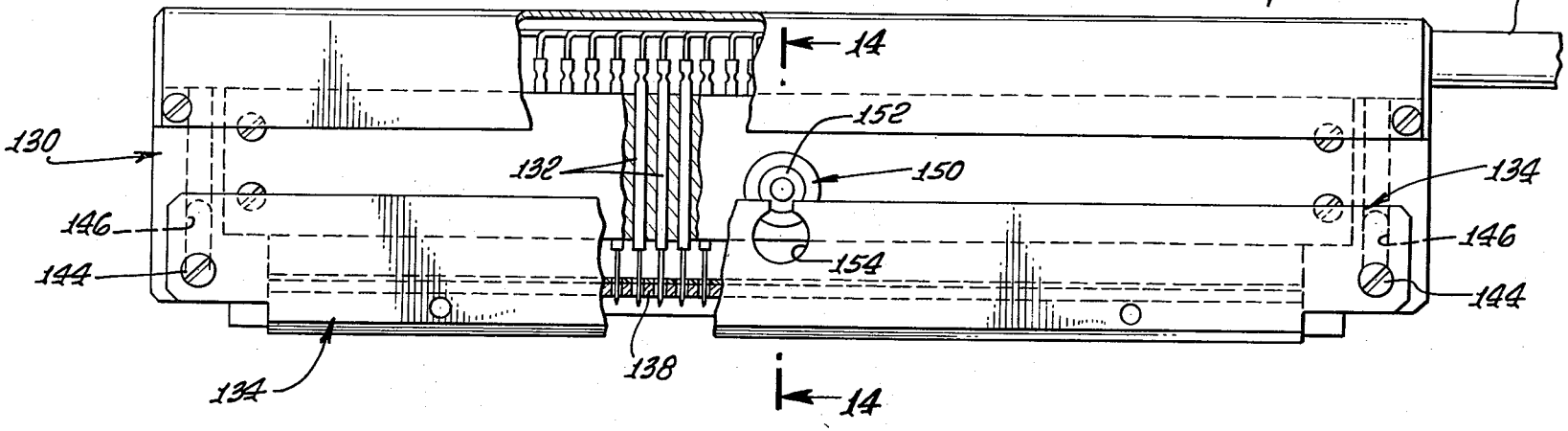
FIG. 12 is an elevational view, partially in section, of a bridge-module cap shoe of the invention.

Movement of the slide member 134 between its extended position, FIG. 12, and its retracted position, FIG. 13, is limited by engagement of stop screws 144, FIGS. 12 and 13, with the outer and inner ends, respectively, of slots 146 in much the same manner as in the connector-module cap shoe 60.

The slide member 134 is adapted to be releasably latched in its retracted position, FIG. 13, wherein the contact pins 132 provide electrical connections through the access holes 54 in the bridge-module cap 50, by a latch means 150, FIGS. 12–15. More particularly, the latch means 150 comprises a spring loaded latch member 152 carried by the bridge-module cap shoe body 130 and laterally outwardly insertable into a C-shaped opening 154 in one of the slide member flanges 136. The operator can release the latch means 150, to permit movement of the slide member 134 into its extended position, by pressing inwardly on the latch member 152 with his thumb, the slide member 134 being spring biased outwardly toward its extended position in a manner not specifically shown, but essentially the same as the manner in which the slide member 110 of the connector-module cap shoe 60 is biased outwardly toward its extended position.

The operation of the bridge-module cap shoe 70 is very similar to that of the connector-module cap shoe 60, with differences which will be apparent from the foregoing description. Consequently, a detailed explanation herein is not necessary.

Figure 18:
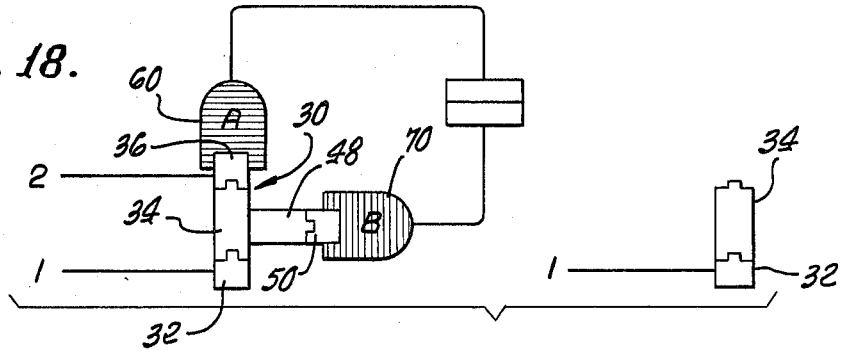
FIG. 18 is a diagrammatic view schematically showing the connector-module cap shoe and the bridge-module cap shoe of the invention in their respective operative relationships with the corresponding components of the connector.

FIG. 17 discloses structurally, and FIG. 18 schematically, how the connector-module cap shoe 60 and the bridge-module cap shoe 70 may be used simultaneously on the connector 30, with the connector-module cap shoe 60 applied to the combination of the index strip 32, the connector module 34 and the connector-module cap 36, and the bridge module cap shoe 70 applied to the bridge module 48 and the bridge-module cap 50.

Figure 19:
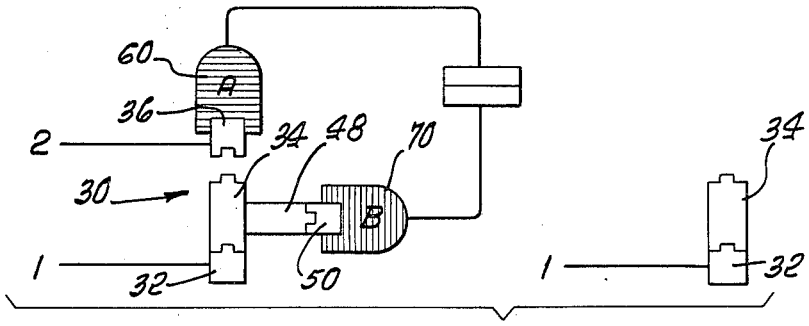
FIG. 19 is a diagrammatic view similar to FIG. 18, but schematically showing the connector-module and bridge-module cap shoes in their operative relationships with the corresponding connector components, but with the connector-module cap spaced from the connector module.

FIG. 19 is very similar to FIG. 18, but shows schematically how the connector-module cap shoe 60 may be applied to the index strip 32, or the connector-module cap 36, prior to assembly of such component with the connector module 34.

Figure 20:
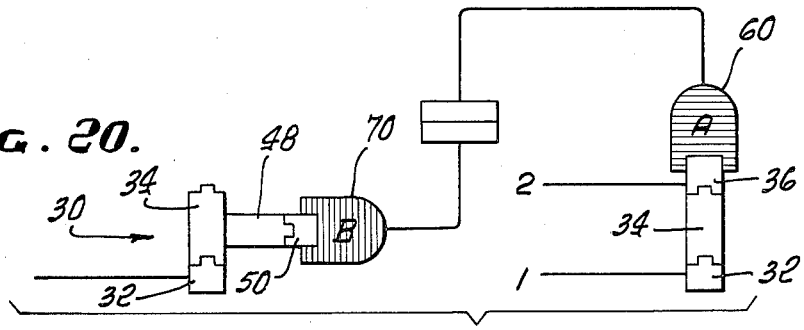
FIG. 20 is a diagrammatic view schematically showing the connector-module cap shoe in its operative relation with the index strip, connector module and connector-module cap of the connector, and showing the bridge-module cap shoe of the invention in its operative relation with the bridge module and the bridge-module cap of the connector.

FIG. 20 shows how the connector-module cap shoe 60 may be use in conjunction with the index strip 32, or the connector-module cap 36, of one connector, while the bridge-module cap shoe 70 is used in connection with the bridge module 48 and the bridge-module cap 50 of another connector.

Although exemplary embodiments of the invention have been disclosed herein for purposes of illustration, it will be understood that various changes, modifications and substitutions may be incorporated in such embodiments without departing from the invention as hereinafter claimed.

We claim as our invention:

1. In a cap shoe for making electrical connections between a plurality of conductors in a first cable and a corresponding plurality of conductors in a connector module of an elongate strip connector which includes an index strip, the connector module, and a cap, the cap having access holes leading to the respective conductors in the connector module, the connector module including means for terminating the ends of conductors of a second cable, the combination of:

a cap shoe body of a size and shape to accommodate the connector and having an elongate central section with first and second arms projecting from opposite ends of said central section forming a first U shaped receptacle for the connector, with an inwardly projecting guide ridge on each of said arms for sliding engagement with the connector;

releasable means for securing said cap shoe body to the connector;

a plurality of spring loaded contact pins carried in a line along said central section of said cap shoe body and insertable through the respective access holes in the cap into electrical contact with the respective conductors in the connector module, each of said pins including means for terminating the end of a conductor of the first cable, with said cap shoe body including means for receiving the first cable;

a second U shaped slide member mounted on said cap shoe body with the arms of said slide member embracing said body and slidable relative thereto between extended and retracted positions in a direction parallel to the axes of said contact pins, and including an elongate spacer between the arms of said slide member with openings in a line through which said contact pins extend; and compression spring means positioned within said cap shoe body and engaging said body and slide member urging said slide member away from said body for ejecting the connector from said body;

whereby said extending contact pins enter the access holes in the cap into electrical contact with the respective conductors in the connector module upon retraction of said slide member by sliding said cap shoe body onto the connector and compressing said spring means.

2. A cap shoe as defined in claim 1 wherein said releasable means includes coaxial retaining pins respectively carried by said first and second arms and extensible inwardly toward each other under the index strip of the connector, the slide member automatically retracting upon insertion of the connector between said arms on said cap shoe body and upon inward extension of said retaining pins, whereby said contact pins enter the access holes in the cap into electrical contact with the respective conductors in the connector module.

3. A cap shoe according to claim 1 wherein said slide member includes transverse bars between said arms thereof and riding in slots of said body for limiting movement of said slide member on said body, with said spring means engaging said bars.

4. In a cap shoe for making electrical connections between a plurality of conductors in a first cable and a corresponding plurality of conductors in an elongate strip connector which includes an index strip, a connector module, and a cap, the index strip having access holes leading to the respective conductors in the connector, the index strip including means for terminating the ends of conductors of a second cable, the combination of:

a cap shoe body of a size and shape to accommodate the connector and having an elongate central section with first and second arms projecting from opposite ends of said central section forming a first U shaped receptacle for the connector, with an inwardly projecting guide ridge on each of said arms for sliding engagement with the connector;

releasable means for securing said cap shoe body to the connector;

a plurality of spring loaded contact pins carried in a line along said central section of said cap shoe body and insertable through the respective access holes in the index strip into electrical contact with the respective conductors in the connector, each of said pins including means for terminating the end of a conductor of the first cable, with said cap shoe body including means for receiving the first cable;

a second U shaped slide member mounted on said cap shoe body with the arms of said slide member embracing said body and slidable relative thereto between extended and retracted positions in a direction parallel to the axes of said contact pins, and including an elongate spacer between the arms of said slide member with openings in a line through which said contact pins extend; and compression spring means positioned within said cap shoe body and engaging said body and slide member urging said slide member away from said body for ejecting the connector from said body;

whereby said contact pins enter the access holes in the index strip into electrical contact with the respective conductors in the connector upon retraction of said slide member by sliding said cap shoe body onto the connector and compressing said spring means.

5. In a cap shoe for making electrical connections between a plurality of conductors in a first cable and a corresponding plurality of conductors in a bridge module of an elongate strip connector which includes an index strip, a connector module, a connector-module cap, and the bridge module, the bridge module being mounted on the connector and including a bridge-module cap having access holes leading to the respective conductors in the bridge module, the bridge module including means for terminating the ends of conductors of a second cable, the combination of:

a cap shoe body of a size and shape to accommodate the bridge module and the bridge-module cap and having an an elongate central section with first and second arms projecting from opposite ends of said central section forming a first U shaped receptacle for the connector, with an inwardly projecting guide ridge on each of said arms for sliding engagement with the connector;

releasable means for securing said cap shoe body to the bridge module;

a plurality of spring loaded contact pins carried in a line along said central section of said cap shoe body and insertable through the respective access holes in the bridge-module cap into electrical contact with the respective conductors in the bridge module, each of said pins including means for terminating the end of a conductor of the first cable, with said cap shoe body including means for receiving the first cable;

a second U shaped slide member mounted on said cap shoe body with the arms of said slide member embracing said body and slidable relative thereto between extended and retracted positions in a direction parallel to the axes of said contact pins, and carrying an elongate spacer between the arms of said slide member with openings in a line through which said contact pins extend; and compression spring means positioned within said cap shoe body and engaging said body and slide member urging said slide member away from said body for ejecting the connector from said body;

whereby said contact pins enter the access holes in the bridge-module cap into electrical contact with the respective conductors in the bridge module upon retraction of said slide member by sliding said cap shoe body onto the connector and compressing said spring means.

6. A cap shoe according to claim 5 including interengageable means on said cap shoe body and said slide member for releasably securing said slide member in its retracted position.

7. In a cap shoe system for making electrical connections between pluralities of conductors in first and second cables and corresponding pluralities of conductors in a connector module and a bridge module of an elongate strip connector which includes an index strip, the connector module, a connector-module cap, the bridge module, and a bridge-module cap, the connector-module and bridge-module caps having access holes leading to the respective conductors in the connector and bridge modules, the connector module including means for terminating the ends of conductors of a third cable, the combination of:

a connector-module cap shoe body of a size and shape to accommodate the index strip, the connector module, and the connector-module cap and having an elongate central section with first and second arms projecting from opposite ends of said central section forming a first U shaped receptacle for the connector, with an inwardly projecting guide ridge on each of said arms for sliding engagement with the connector;

releasable means for securing said connector-module cap shoe body to the connector;

a plurality of spring loaded contact pins carried in a line along said central section of said connector-module cap shoe body and insertable through the respective access holes in the connector-module cap into electrical contact with the respective conductors in the connector module, each of said pins including means for terminating the end of a conductor of the first cable, with said cap shoe body including means for receiving the first cable;

a second U shaped connector-module slide member mounted on said connector-module cap shoe body with the arms of said slide member embracing said body and slidable relative thereto between extended and retracted positions in a direction parallel to the axes of and having an elongate spacer between the arms of said slide member with openings in a line for said contact pins in said connector-module cap shoe body;

first compression spring means positioned within said connector-module cap shoe body and engaging said body and slide member urging said slide member away from said body for ejecting the connector from said body;

whereby said extending contact pins in said connector-module cap shoe body enter the access holes in the connector-module cap into electrical contact with the respective conductors in the connector module upon retraction of said connector-module slide member by sliding said cap shoe body onto the connector and compressing said first spring means;

a bridge-module cap shoe body of a size and shape to accommodate the bridge module and the bridge module cap and having an elongate central section with first and second arms projecting from opposite ends of said central section forming a third U shaped receptacle for the connector, with an inwardly projecting guide ridge on each of said arms for sliding engagement with the connector;

a plurality of spring loaded contact pins carried in a line along said central section of said bridge-module cap shoe body and insertable through the respective access holes in the bridge-module cap into electrical contact with the respective conductors in the bridge module, each of said pins including means for terminating the end of a conductor of the second cable, with said cap shoe body including means for receiving the second cable;

a fourth U shaped bridge slide member mounted on said bridge-module cap shoe body with the arms of said slide member embracing said body and slidable relative thereto between extended and retracted positions in a direction parallel to the axes of and having an elongate spacer between the arms of said slide member with openings in a line for said contact pins in said bridge-module cap shoe body; and second compression spring means positioned within said bridge-module cap shoe body and engaging said body and slide member urging said slide member away from said body for ejecting the connector from said body;

whereby said extending contact pins in said bridge-module cap shoe body enter the access holes in the bridge-module cap into electrical contact with the respective conductors in the bridge module upon retraction of said bridge-module slide member by sliding said cap shoe body onto the connector and compressing said second spring means.

* * * * *